US009788642B2

(12) United States Patent
Lee

(10) Patent No.: US 9,788,642 B2
(45) Date of Patent: Oct. 17, 2017

(54) TOOTHBRUSH

(71) Applicants: NEOB CO., LTD., Busan (KR); Pal Hyung Lee, Daegu (KR)

(72) Inventor: Pal Hyung Lee, Daegu (KR)

(73) Assignees: NEOB CO., LTD., Busan (KR); Pal Hyung Lee, Daegu (KR)

( * ) Notice: Subject to any disclaimer, the term of this patent is extended or adjusted under 35 U.S.C. 154(b) by 0 days.

(21) Appl. No.: 14/665,227

(22) Filed: Mar. 23, 2015

(65) Prior Publication Data

US 2015/0189978 A1 Jul. 9, 2015

Related U.S. Application Data

(63) Continuation of application No. PCT/KR2013/000504, filed on Jan. 22, 2013.

(30) Foreign Application Priority Data

Sep. 21, 2012 (KR) ..... 10-2012-0105295

(51) Int. Cl.
*A46B 9/04* (2006.01)
*A46B 7/06* (2006.01)
(Continued)

(52) U.S. Cl.
CPC ..... *A46B 5/0025* (2013.01); *A46B 9/04* (2013.01); *A46B 5/0095* (2013.01); *A46B 7/02* (2013.01); *A46B 7/04* (2013.01)

(58) Field of Classification Search
CPC .... A46B 7/00; A46B 7/04; A46B 3/16; A46B 5/0095; A46B 1/00; A46B 7/06; A46B 9/04
(Continued)

(56) References Cited

U.S. PATENT DOCUMENTS 1,518,341 A * 12/1924 Mendoza ..... A46B 11/0079 15/176.4
2,266,195 A * 12/1941 Hallock ..... A46B 5/0025 15/167.1
(Continued)

FOREIGN PATENT DOCUMENTS

IL WO 03001943 A1 * 1/2003 ..... A46B 3/20
JP 2002-51838 A 2/2002
(Continued)

OTHER PUBLICATIONS

WIPO, International Search Report (PCT/KR2013/000504), Jun. 13, 2013.

*Primary Examiner* — Michael Jennings
(74) *Attorney, Agent, or Firm* — Novick, Kim & Lee, PLLC; Jae Youn Kim

(57) ABSTRACT

Disclosed herein is a toothbrush. The toothbrush (1) includes a head (2), and a through hole (3) formed vertically through the head. The through hole (3) is formed in one or more portions by a predetermined length at a predetermined portion around a front, back, left or right of the bristle body (5) to prevent the bristle body (5) from being separated from the head (2). The bristle body (5) and the head (2) are connected to each other by one or more connecting portions. This toothbrush enables the bristle body implanted with bristles to freely and flexibly move upwards, downwards, leftwards or rightwards in the through hole of the head, so that the bristle body flexibly moves so as to adapt to various shapes of the teeth when brushing the teeth, thereby maximizing the contact area between the teeth and the bristles as well as the brushing effect.

6 Claims, 5 Drawing Sheets

(51) Int. Cl.
*A46B 5/00* (2006.01)
*A46B 7/04* (2006.01)
*A46B 7/02* (2006.01)

(58) Field of Classification Search
USPC ..... 15/105, 167.1, 188, 187, 110
See application file for complete search history.

(56) References Cited

U.S. PATENT DOCUMENTS 2,706,825 A * 4/1955 Blakeman ..... A46B 5/0029 15/167.1
3,738,761 A * 6/1973 Segerstad ..... A46B 11/0027 15/176.2
4,128,910 A * 12/1978 Nakata ..... A46B 3/005 15/110
4,227,276 A * 10/1980 Ginsburg ..... A46B 5/00 15/167.1
5,398,366 A * 3/1995 Bradley ..... A46B 7/06 15/167.1
5,524,319 A * 6/1996 Avidor ..... A46B 7/06 15/167.1
5,839,149 A * 11/1998 Scheier ..... A46B 5/0029 15/167.1
6,141,817 A * 11/2000 Dawson ..... A46B 7/06 15/167.1
6,487,748 B1 * 12/2002 Dardar ..... A46B 7/04 15/167.1
7,174,596 B2 * 2/2007 Fischer ..... A46B 3/06 15/110
8,281,448 B2 * 10/2012 Waguespack ..... A46B 5/0025 15/167.1
8,332,982 B2 * 12/2012 Braun et al. ..... 15/22.1
8,448,287 B2 * 5/2013 Ponzini et al. ..... 15/176.1
8,590,095 B2 * 11/2013 Crossman ..... A46B 7/06 15/167.1
2002/0178524 A1 * 12/2002 Hawkins ..... A46B 7/02 15/167.1
2003/0066147 A1 * 4/2003 Roh ..... A46B 7/08 15/28
2003/0074755 A1 * 4/2003 Ale ..... A46B 7/04 15/167.1
2004/0194238 A1 * 10/2004 Letendre ..... A46B 7/04 15/22.2
2008/0104785 A1 * 5/2008 Robinson ..... A46D 1/055 15/167.1
2012/0073070 A1 * 3/2012 Nirwing ..... A46B 9/08 15/167.1
2012/0204370 A1 * 8/2012 Crossman ..... A46B 7/06 15/167.1

FOREIGN PATENT DOCUMENTS

KR 10-0210638 B1 7/1999
KR 10-0606524 B1 7/2006
KR 10-2007-0037474 A 4/2007
KR 10-2011-0106183 A 9/2011
WO 92/17092 A1 10/1992
WO WO 03099062 A1 * 12/2003

* cited by examiner

TOOTHBRUSH

REFERENCE TO RELATED APPLICATIONS

This is a continuation of pending International Patent Application PCT/KR2013/000504 filed on Jan. 22, 2013, which designates the United States and claims priority of Korean Patent Application No. 10-2012-0105295 filed on Sep. 21, 2012, the entire contents of which are incorporated herein by reference.

FIELD OF THE INVENTION

The present invention relates, in general, to toothbrushes and, more particularly, to a toothbrush, in which a bristle body implanted with bristles is configured to flexibly move upwards, downwards, leftwards or rightwards in a head of the toothbrush according to the dental shape, thus increasing a contact area as well as a frictional force between the teeth and the bristles and thereby maximizing the removal of dental plaque and food remnants by brushing, the result of which contributes to oral hygiene.

BACKGROUND OF THE INVENTION

A common toothbrush is designed such that bristles forming a brush are implanted at regular intervals on a head having the shape of a flat plate. In order to maximize the brushing effect by causing the brush to come into close contact with a curved surface of the teeth, a variety of methods are applied: different lengths may be assigned to the bristles to adjust the height thereof, large or small diameters may be provided to the bristles, or the bristles may be arranged in various patterns.

SUMMARY OF THE INVENTION

However, a conventional toothbrush is problematic in that bristles are implanted on a head having the shape of a fixed flat plate. This has the result that the bristles cannot fully come into contact with the teeth during brushing, a contact area is small, a frictional force is low, and thereby a frictional force of the bristles does not act uniformly on the surface of the teeth during the act of brushing; with the result that the brushing effect is inevitably lowered. The present invention is intended to provide a toothbrush that can solve these problems of the conventional toothbrush.

Particularly, the inventor of the present invention proposed Korean Patent Application No. 10-2010-0025447. According to this document, a bristle body independently manufactured is attached to an elastic member located at a lower position within a head of a toothbrush in various ways. Thus, when a user brushes his or her teeth, the bristle body is flexibly operated vertically and horizontally by the elastic member within the head, thereby increasing the frictional force of the bristles. In contrast, according to the present invention, the bristle body and the head of the toothbrush are not separate from each other but are integrated using a single material by injection molding, thereby reducing a manufacturing cost thereof and allowing the flexibly operable toothbrush to be more conveniently manufactured as compared to the existing method. Hence, the contact area of the bristles of the toothbrush can be uniformized regardless of the dental shape during brushing, thus maximizing the removal of dental plaque due to an increase in frictional force between the bristles and the teeth. Further, its manufacturing process is simplified, so that the cost of the toothbrush is lowered.

Consequently, it is possible for every person to purchase such a functional toothbrush at a low price, thus having a beneficial effect on the teeth and the gums and improving oral hygiene, and thereby contributing to the oral health of humankind.

In an aspect, the present invention provides a toothbrush, wherein a through hole is formed vertically through a head of the toothbrush, a bristle body implanted with bristles in the through hole is partially connected at one or more portions thereof to an upper or lower portion of a front or back of the head within the head of the toothbrush, is partially connected at one or more portions thereof to an upper or lower portion of a left or right of the head, or is partially connected at two or more portions thereof to an upper or lower portion of the front, back, left or right of the head, thus allowing the bristle body to be flexibly moved upwards and downwards or leftwards and rightwards in the head of the toothbrush during brushing, and maximizing a contact area while the bristles are flexibly moved according to the dental shape, and thereby maximizing the brushing effect due to an increase in frictional force.

As described above, the toothbrush according to the present invention is advantageous in that the bristle body implanted with the bristles is installed in the through hole formed vertically through the head of the toothbrush, and the bristle body is partially connected to the upper or lower portion of the front or back of the head in the head of the toothbrush, is partially connected to the upper or lower portion of the left or right thereof, or is partially connected to the front, back, left or right thereof, and the flexibly operable toothbrush having the bristle body and a handle may be manufactured by injection molding at a time, thus reducing manufacturing cost thereof. Further, the toothbrush according to the present invention is advantageous in that the bristle body may be flexibly operated upwards, downwards, leftwards or rightwards during brushing, so that the contact area between the teeth and the bristles is maximized when the dental plaque is removed, thus maximizing the brushing effect and thereby contributing to good oral hygiene.

DETAILED DESCRIPTION OF THE INVENTION

The preferred embodiment of the present invention will be described in detail with reference to the accompanying drawings.

Figure 1:
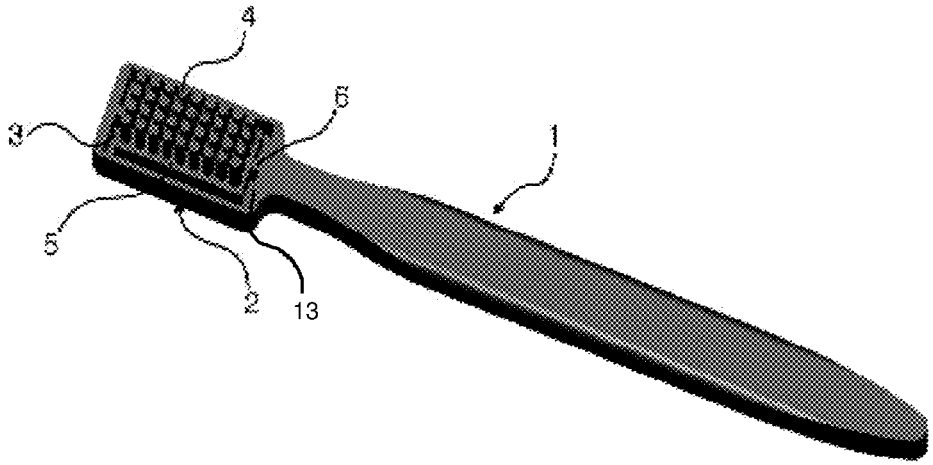
FIG. 1 is a perspective view showing a preferred embodiment of a toothbrush according to the present invention.

That is, as shown in FIG. 1, the toothbrush 1 of the present invention includes a head 2 of the toothbrush and a through hole 3 formed vertically through the head. The through hole 3 is formed at one or more positions between the bristle body 5 and the head 2. In order to integrally connect the bristle body 5 implanted with bristles 4 with the head 2 of the toothbrush in the through hole 3, the bristle body 5 may be partially connected to an upper or lower fixed portion 13 of the front, back, left or right in the head 2 of the toothbrush by one or more connecting portions 6 each having the shape of a line, plane or rod. To be more specific, the through hole 3 of the head 2 is formed in one or more portions by a predetermined length at a predetermined portion around the front, back, left or right of the bristle body 5 in the head 2. In order to integrate the bristle body 5 with the toothbrush head 2 without being separated from each other, the through hole 3 is formed with one or more connecting portions 6 in the shape of the line, plane or rod being provided. Accordingly, the bristle body 5 is flexibly operated in several directions in the head 2 during the brushing depending on the position, shape and number of the connecting portions 6, thus increasing a contact area as well as a frictional force between the teeth and the bristles 4, and thereby contributing to the removal of the dental plaque and superior oral hygiene. When brushing the teeth using the toothbrush configured as such, the bristles 4 are first moved according to the dental shape by the force transmitted from the wrist in several directions, and then the bristle body 5 implanted with the bristles 4 is secondarily subjected to the force. Consequently, the force causes the connecting portion 6 to be temporarily distorted, and simultaneously, concentrates on the connecting portion 6, so that it momentarily acts as an elastic restoring force. Hence, while the bristle body 5 is flexibly moved upwards, downwards, leftwards and rightwards, the contact area and the frictional force are increased between the teeth and the bristles, so that the removal effect of dental plaque and food remnants is enhanced, in addition to contributing to superior oral hygiene.

To this end, according to the present invention, a through hole 3 formed in a head 2 is wider than the circumference of the bristle body 5 implanted with bristles 4. The bristle body 5 is connected to the head 2 at one or more portions by a connecting portion 6 having various thicknesses and shapes of a line, plane or rod at the upper or lower portion of the front or back, at the upper or lower portion of the left or right, or at the upper or lower portion of the front, back, left or right while the bristle body 5 not being separated from the head 2 in the through hole of the head 2 of the toothbrush. Therefore, the invention may use various methods, such as co-injection molding or high frequency adhesion, so as to ensure the elastic operation of the bristle body 5 as in the prior art. Further, the invention may also use single injection molding when manufacturing the toothbrush, thus advantageously shortening a working time and reducing the cost of a mold and a material. Further, when the toothbrush is manufactured by the injection molding, it is possible to simultaneously make the head 2 and the bristle body 5 formed in the through hole 3 of the head 2.

Figure 2:
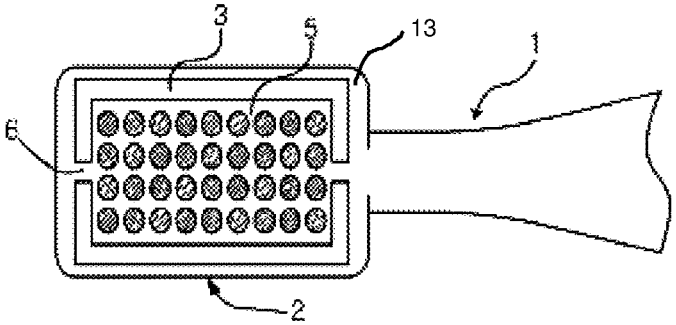
FIGS. 2 to 6 are extracted plan views showing important parts of the toothbrush according to the present invention.
Figure 3:
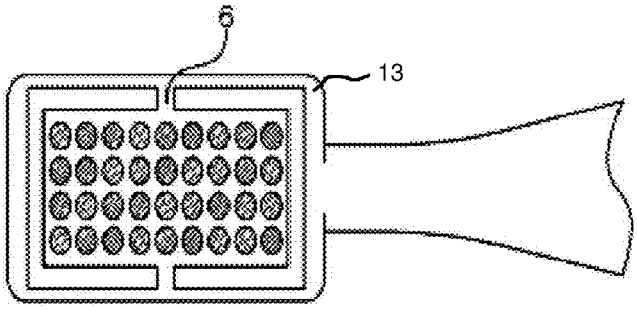
Figure 4:
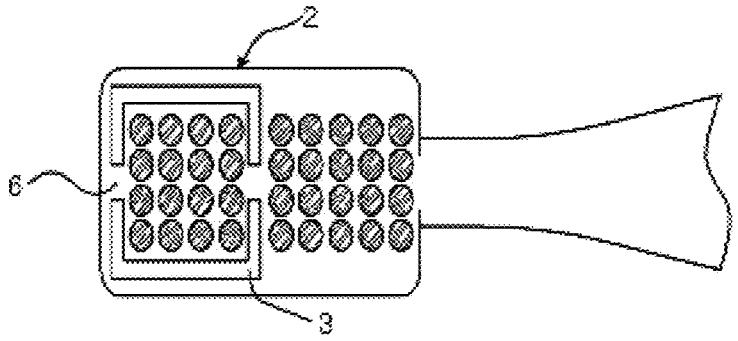
Figure 5:
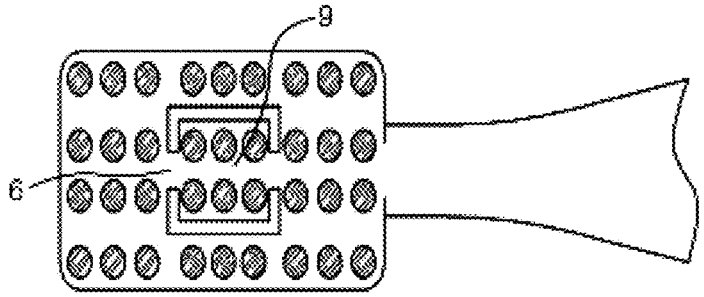
Figure 6:
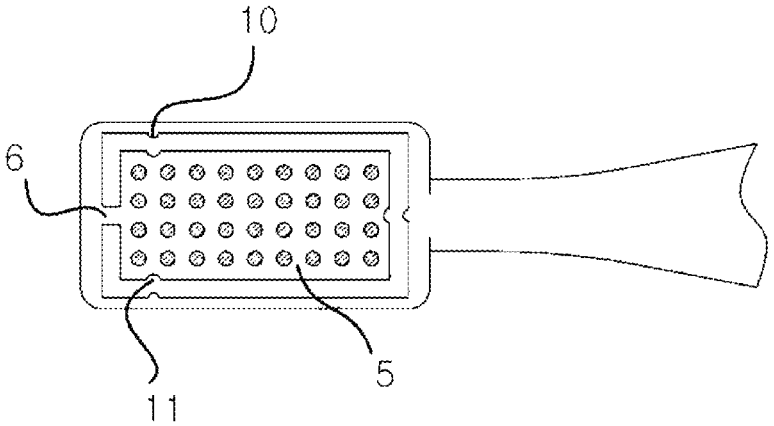

Referring to FIG. 2 as an example, the connecting portions 6 are located at the front and back between the head 2 and the bristle body 5. In an embodiment of FIG. 3, the connecting portions 6 are located at the left and right between the head 2 and the bristle body 5. In an embodiment of FIG. 4, the bristle body 5 is divided into two portions. In an embodiment of FIG. 5, only a predefined portion is taken from the bristle body 5, thus forming a partial bristle body 9. The partial bristle body 9 may be made of several shapes, for example, a rectangular shape or a square shape. In an embodiment of FIG. 6, the connecting portion 6 is located at a position on the front between the head 2 and the bristle body 5. In order to restrict the moving range of the bristle body 5 as necessary during brushing, a convex protrusion 10 is provided on the head 2, and a concave groove 11 is formed in the bristle body 5 to correspond to the convex protrusion. As such, it is possible to apply various configurations.

Figure 7:
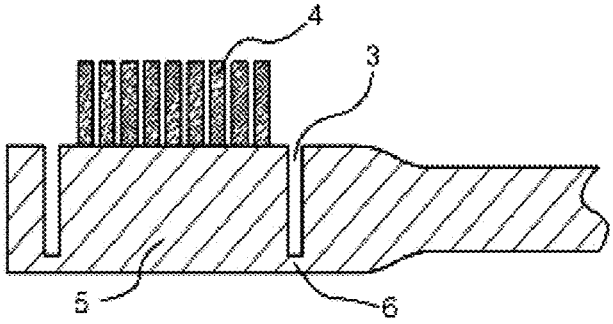
FIGS. 7 to 9 are extracted front sectional views showing important parts of the toothbrush according to the present invention.
Figure 8:
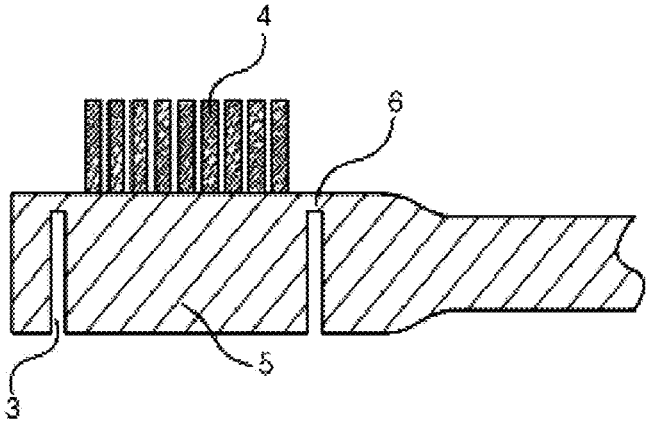
Figure 9:
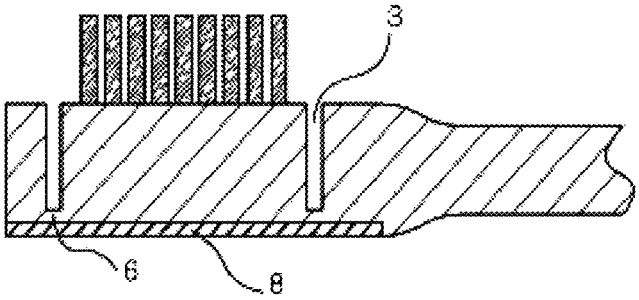
Figure 10:
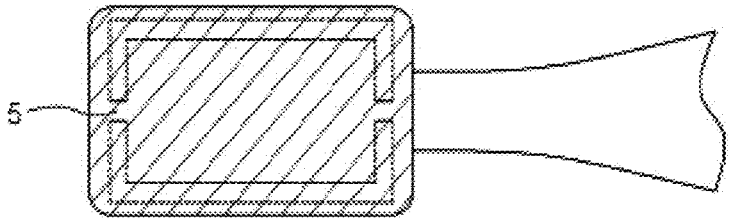
FIG. 10 is an extracted bottom perspective view showing important parts of the toothbrush according to the present invention.

In FIGS. 7 and 8 that are sectional views showing an embodiment of this invention, the connecting portions 6 are partially connected to the upper or lower portion of the front and back of the head 2 and the bristle body. In an example of FIG. 9, the bristle body 5 is connected to the head 2 of the toothbrush via an elastic connecting member 8 made of a material selected from among soft synthetic resin, silicone, and synthetic rubber by one of various methods, such as co-injection molding or high frequency adhesion. Thereby, the elastic force of the bristle body 5 moving in the head 2 during the brushing is further increased. FIG. 10 is a bottom perspective view of the toothbrush 1 when the elastic connecting member 8 is applied. Similarly to the example of FIG. 8 wherein the elastic connecting member 8 is applied, it may be applied to the examples of FIGS. 1, 2, 3, 4, 5, 11, 12, and 13. It is possible to variously apply the elastic connecting member 8 to a portion of the bristle body 5 where elasticity is required.

Figure 11:
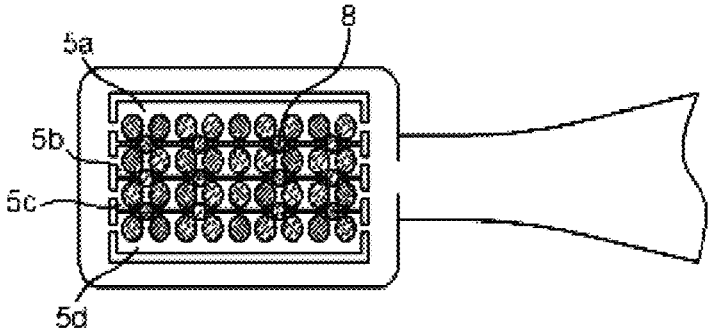
FIGS. 11 and 12 are extracted plan views showing important parts of the toothbrush according to the present invention.

Referring to the example of FIG. 11 having four rows, the bristle body 5 is divided into four individual bristle bodies 13*a* to 13*d* in such a way as to be separated in a horizontal direction for the elastic operation. However, the individual bristle bodies may be separated from each other in a vertical direction as necessary. Thus, as shown in the above example, the bristle body may be divided into one row for each of opposite sides and two rows for a center, namely, into three portions. In this case, only the opposite sides may be flexibly operated or only the two rows of the center may be flexibly operated while the opposite sides are kept intact. Further, the bristle body may be divided into two rows for opposite sides, namely, two portions, so that two rows may be flexibly operated. Alternatively, in the case of requiring a division in the vertical direction, it is possible to variously divide the bristle body into predetermined portions, as in the horizontal division, for the purpose of the elastic operation. If necessary, the central portion of the bristle body 5 may be taken in a rectangular shape, thus allowing only the central portion to be flexibly operated. As mentioned above, FIG. 11 shows the example of the present invention wherein the bristles are implanted in four rows in the horizontal direction. Each of the individual bristle bodies 13 divided into four portions is thinly and partially connected to the front or back of the head 2 at both and either of the upper and lower portions in the through hole of the head 2 of the toothbrush, in the shape of various lines or planes. Thus, during the brushing, the individual bristle body 13 is flexibly operated leftwards or rightwards in the head 2 of the toothbrush. By the "bristle body 5 is divided or separated" in this context, it is meant that the bristle body 5 is not completely cut off from the head 2 but the bristle body 5 is connected at one or more portions to the head 2 via the connecting portion 6.

Further, as necessary, a number of elastic connecting members 8 each having the shape of a pin may be fixed between the individual bristle bodies 13*a* to 13*d* by rubber injection molding, high frequency adhesion or the like.

Of course, when viewed on a plane, the head 2 may have various shapes including a rectangular shape or an oblong shape. If the head 2 has the oblong shape, the through hole 3 and the bristle body 5 may also be manufactured to have the oblong shape.

Figure 12:
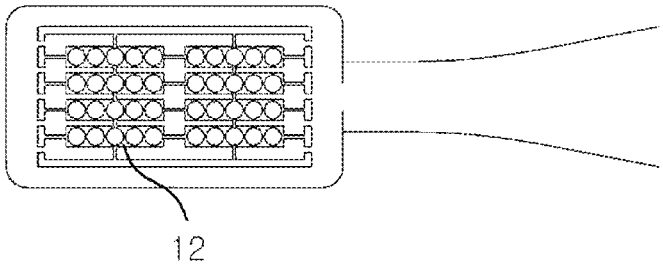

In FIG. 12, the individual bristle body 13 is divided again into individual partial bristle bodies 12 having one implanting hole or a required number of implanting holes. The individual partial bristle bodies 12 are connected at front, back, left and right by one or more connecting portions 6, so that many individual partial bristle bodies 12 are formed in a grid pattern in the head 2 and thus are flexibly operated in the head 2. To be more specific, the individual bristle body 13 is divided into the individual partial bristle bodies 12 having one or more implanting holes, and the individual partial bristle bodies 12 having one or more implanting holes are connected at the front, back, left and right thereof by one or more connecting portions 6 in the through hole 3 defined in the head 2. Particularly, as shown in the drawing, the individual partial bristle bodies 12 formed by dividing the individual bristle body 13*a* or the individual bristle body 13*d* may be connected to the side of the head 2 by the connecting portions 6. Thus, the individual partial bristle bodies 12 divided into several portions are connected to each other like a mesh in the toothbrush head 2 to be flexibly operated.

Figure 13:
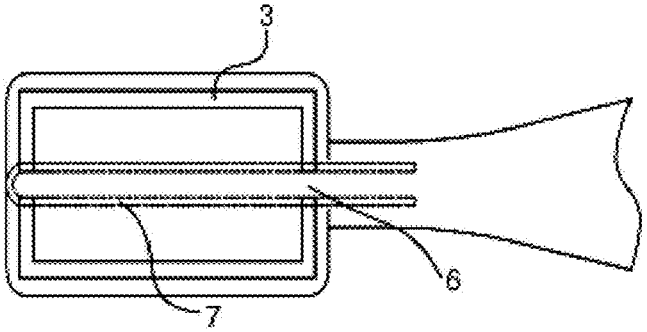
FIG. 13 is an extracted bottom perspective view showing important parts of the toothbrush according to the present invention.
Figure 14:
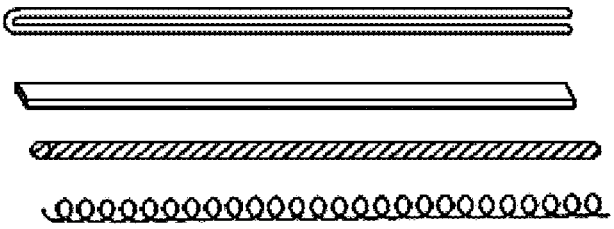
FIG. 14 is a view illustrating an example of an elastic member according to the present invention.
Figure 15:
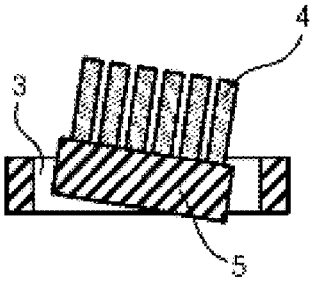
FIG. 15 is a left sectional view illustrating the flexibly vertical and horizontal movement of the toothbrush according to the present invention.

The example of FIG. 13 uses a reinforcing member 7 to further increase the elastic force of the bristle body 5 in the head 2, and the example of FIG. 14 shows several types of reinforcing members 7. In order to further increase the elastic force of the bristle body 5 moving in the head 2 during brushing, it is possible to use the reinforcing member 7 of several materials and kinds that are harmless to the human body, prior to the injection molding. For example, a rectangular thin leaf spring, a double wire of the shape of a hairpin, several strands of twisted wire, a coil spring or the like is horizontally or vertically fixed in a mold at the upper or lower portion at which the head 2 is connected with the bristle body 5, and then the reinforcing member 7, selected from the above-mentioned example, is fitted in the head 2 and the bristle body 5 while or after the toothbrush is manufactured by the injection molding. Therefore, it is possible to more reliably ensure the elastic operation of the bristle body 5 during the brushing. FIG. 15 is the sectional view showing the example wherein the bristle body 5 connected to the head 2 via one connecting portion 6 at the front or rear in the head 2 is flexibly operated leftwards or rightwards.

When a user brushes his or her teeth using the toothbrush 1 of the present invention configured as described above, the bristle body 5 implanted with the bristles 4 is flexibly moved upwards, downwards, leftwards and rightwards according to the dental shape, so that a contact area between the bristles 4 and the teeth is maximized, and the brushing is more effectively performed. That is, the bristle body 5 implanted with the bristles 4 is fixed to the head 2, and the width and length of the bristle body 5 are smaller than those of the through hole 3 formed in the head 2. Thus, a clearance is secured for the bristle body 5 that is flexibly operated vertically or horizontally in the head 2 during brushing, so that the bristle body 5 is flexibly moved during brushing. Consequently, the bristles 4 are moved according to the dental shape, thus increasing both the contact area and the frictional force and enhancing the brushing effect.

As described above, the present invention provides a toothbrush, which appropriately adjusts pressure exerted on the teeth by a toothbrush user, thus minimizing tooth abrasion and damage to periodontal tissue due to brushing, and allowing a patient suffering a periodontal disease to more easily use Bass Technique brushing, and thereby contributing to both clean gums and healthy periodontal tissue.

What is claimed is:

1. A toothbrush, comprising:

a head, wherein the head comprises:

at least two through holes formed vertically through the head;

at least one elastically movable bristle body substantially surrounded by the at least two through holes;

a fixed portion disposed at a peripheral area of the at least one elastically movable bristle body; and at least two elastic connection portions unitarily connected to the fixed portion, thereby enabling the at least one elastically movable bristle body to move relative to the fixed portion when the toothbrush is used for brushing one's teeth with a compressive force applied to the at least one elastically movable bristle body; and a reinforcing member configured to reinforce an elastic operation of the at least one bristle body in the head of the toothbrush, wherein the at least one elastically movable bristle body is connected to the head by the reinforcing member and is selected from among a leaf spring, a double wire, a twisted wire, and a coil spring.

2. The toothbrush according to claim 1, further comprising an elastic connecting member of planar shape disposed under the head, the elastic connecting member formed of a material selected from soft synthetic resin, silicone, and synthetic rubber.

3. The toothbrush according to claim 1, wherein the head and the at least one bristle body are made of a material selected from among synthetic resin, silicone, and synthetic rubber, and are unitarily formed into a single piece by injection molding.

4. The toothbrush according to claim 1, wherein the at least one elastically movable bristle body comprises a plurality of individual bristle bodies divided and arranged in rows, each of the plurality of individual bristle bodies being connected to its neighboring individual bristle body via at least one elastic connector, thereby enabling the plurality of individual bristle bodies to move relative to one another about the at least one elastic connector when the toothbrush is used for brushing one's teeth.

5. The toothbrush according to claim 1, wherein the at least two through holes are disposed at an edge area of the head, and the at least one elastically movable bristle body is disposed at a central portion of the head.

6. A toothbrush, comprising:

a head, wherein the head comprises:

at least two through holes formed vertically through the head;

at least one elastically movable bristle body substantially surrounded by the at least two through holes;

a fixed portion disposed at a peripheral area of the at least one elastically movable bristle body;

at least two elastic connection portions unitarily connected to the fixed portion, thereby enabling the at least one elastically movable bristle body to move relative to the fixed portion when the toothbrush is used for brushing one's teeth with a compressive force applied to the at least one elastically movable bristle body, and wherein the at least one elastically movable bristle body comprises a plurality of individual bristle bodies, a plurality of gaps disposed therebetween, and a plurality of elastic connecting members placed between the plurality of individual bristle bodies, wherein each of said elastic connecting members is in a shape of a pin and made of a material selected from among soft synthetic resin, silicone, and synthetic rubber.

* * * * *